US012186640B2

(12) United States Patent
Bonfigli

(10) Patent No.: US 12,186,640 B2
(45) Date of Patent: Jan. 7, 2025

(54) BEACH TENNIS RACQUET WITH HITTING SURFACE TO SIMULATE TENNIS STRINGS

(71) Applicant: SEXY BRAND LLC, Hermosa Beach, CA (US)

(72) Inventor: Mark Bonfigli, Shelburne, VT (US)

(73) Assignee: SEXY BRAND LLC

( * ) Notice: Subject to any disclaimer, the term of this patent is extended or adjusted under 35 U.S.C. 154(b) by 962 days.

(21) Appl. No.: 17/209,010

(22) Filed: Mar. 22, 2021

(65) Prior Publication Data

US 2022/0296973 A1 Sep. 22, 2022

(51) Int. Cl.

| | |
|---|---|
| ***A63B 59/42*** | (2015.01) |
| ***A63B 59/48*** | (2015.01) |
| ***A63B 60/50*** | (2015.01) |
| *A63B 102/02* | (2015.01) |

(52) U.S. Cl.

CPC ..... *A63B 59/42* (2015.10); *A63B 59/48* (2015.10); *A63B 60/50* (2015.10); *A63B 2102/02* (2015.10)

(58) Field of Classification Search

CPC ..... A63B 59/42; A63B 2102/08

See application file for complete search history.

(56) References Cited

U.S. PATENT DOCUMENTS

| | | | | | |
|---|---|---|---|---|---|
| 5,326,097 | A * | 7/1994 | Yu | A63B 60/40 | 473/528 |
| D827,741 | S * | 9/2018 | Bonfigli | D21/729 | |
| 2015/0024879 | A1* | 1/2015 | Kapheim | A63B 59/48 | 473/530 |
| 2016/0107053 | A1* | 4/2016 | Pree | A63B 59/42 | 473/529 |
| 2018/0104555 | A1* | 4/2018 | Taylor | A63B 59/45 | |
| 2022/0266106 | A1* | 8/2022 | Nygren | A63B 59/45 | |

FOREIGN PATENT DOCUMENTS

| | | | | | |
|---|---|---|---|---|---|
| CN | 201760048 | U * | 3/2011 | | |
| CN | 213049281 | U * | 4/2021 | | |
| CN | 218853434 | U * | 4/2023 | | |
| CN | 220095781 | U * | 11/2023 | | |
| EP | 4245383 | A1 * | 9/2023 | | A63B 59/42 |
| TW | 623441 | U * | 2/2022 | | A63B 59/48 |
| WO | WO-2023172209 | A1 * | 9/2023 | | A63B 59/48 |

* cited by examiner

*Primary Examiner* — Joshua T Kennedy

(74) *Attorney, Agent, or Firm* — Fulwider Patton LLP

(57) ABSTRACT

A beach tennis racquet is disclosed having a handle and frame enclosing a striking element. The striking element is a composite comprising a core and a plurality of ultrathin carbon fiber layers that are fused into a solid surface of no more than two millimeters in thickness. The striking surface is centered in the frame of the racquet and inset from the frame in a manner similar to a tennis racquet.

9 Claims, 4 Drawing Sheets

BEACH TENNIS RACQUET WITH HITTING SURFACE TO SIMULATE TENNIS STRINGS

BACKGROUND

Beach tennis is a rapidly growing sport played in almost every country around the world. Beach tennis is played with multiple players, typically two or four players, where a small rubber ball is volleyed back and forth between the players using a wooden paddle. Similar to traditional tennis, beach tennis preserves most of the rules and scoring of tennis, although some modifications have been made to adapt to movement around the sand court and to the faster pace of the game. With beach tennis, the ball cannot touch the ground and thus the game is played entirely with volleys. Due to this rule, beach tennis makes for a quick, intense, and exciting game. Points start with a serve and end when the ball touches the ground, forcing players to dive to reach difficult plays, similar to volleyball. As with tennis, the objective is to return the ball with only one hit so that it reaches the opposing side of the net.

The sport uses a depressurized tennis ball to make for longer rallies as it will travel more slowly through the air than a regulation tennis ball. The sport is (usually) played by two-person teams on a regulation beach volleyball court with a 5-foot-7-inch-high net. Beach tennis emerged in Italy in the early 1970s when tennis players on vacation in Lido degli Estensi (Ferrara) decided to try out tennis with tennis rackets using the existing volleyball nets already installed. In 1976 it then was played for the first time, with the rules as we know them today, in Torredembarra, Spain. Also in Torredembarra was played the first championship in 1978. Since then (with few interruptions) it takes place on the same beach every year. Over the years, the sport spread to the beaches along the coast of Italy, and it is estimated that today there are more than 1,600 beach tennis nets along the coast of Italy, and that number does not include the constantly growing number of inland and indoor courts. An estimated 250,000 Italian beach tennis players have made the sport so popular that the infrastructure for tournaments has taken on incredible proportions, check out some of these exotic destinations where beach tennis courts are being set up.

Beach tennis only started spreading around the world in the early 2000s, but it has quickly gained popularity in coastal areas all around the world. It has been registered that beach tennis is being played in over 53 countries all around the world. Italy Spain Portugal France United Kingdom Belgium Germany Hungary Latvia Estonia Lithuania Slovenia Poland Ukraine Bulgaria Holland Austria Finland Denmark Switzerland Czech Republic Belarus Romania Egypt Iran Tunisia Greece Israel Cyprus South Africa Morocco Argentina Chile Peru Brazil Japan Mauritius Puerto Rico Mexico Venezuela Dominican Republic Colombia El Salvador Russia China Australia India Malaysia Singapore United States Canada United Arab Emirates Thailand And many more joining by the day.

In the early stages of beach tennis, rudimentary paddles or tennis racquets were used. Sports paddles and racquets such as that used in Matkot are ubiquitous and come in a wide variety of shapes, sizes, and designs. However, the goal of most beach tennis racquet manufacturers have been to try and replicate the response and feel of a tennis racquet, but with the solid surface paddles favored by beach tennis players. This objective has largely gone unfulfilled because paddles invariably lack the response of a stringed racquet, and tend to deaden the ball when hit, even when a rubberized or equivalent surface is applied to the hitting surface. The inclusion of a woven core surrounded by rubber also yields a paddle that feels heavy and slower, and better players have continuously sought more of a tennis racquet feel and response. There are no beach tennis racquets on the market that cater to this need and to the better player's desire for a racquet that plays like a tennis racquet. The present invention in the solution to this problem.

SUMMARY OF THE INVENTION

The present invention is a beach tennis racquet that has a ultrathin hitting surface which mimics a hitting a racquet with strings, but is a solid and uniform structure with dual hitting surfaces. The racquet uses a frame that includes a handle and a head that surrounds the hitting surface, and the hitting surface is constructed of a multi-layer composite having a thickness on the order of one to one and one half millimeters, or roughly the same thickness as tennis strings. The hitting surface is a unique composite that comprises a non-woven core material onto which multiple layers of carbon fiber or the like are applied. The composite is heated to harden the materials into a very thin, rigid material that replicates the response of tennis racquet strings but with a substantially solid hitting surface. In a preferred embodiment, there are three layers of carbon fiber on each side of the core to provide the ideal response, although fewer or greater number of layers can be applied to adjust the response. The outermost layer of carbon is larger than the core and the previous layers so that it can surround the other layers and attach to the frame. In this manner, a high COR is achieved in a racquet that is durable and caters to high performance players.

These and other features of the invention will best be understood in view of the descriptions below in conjunction with the associated drawings.

DETAILED DESCRIPTION OF THE PREFERRED EMBODIMENTS

Figure 1:
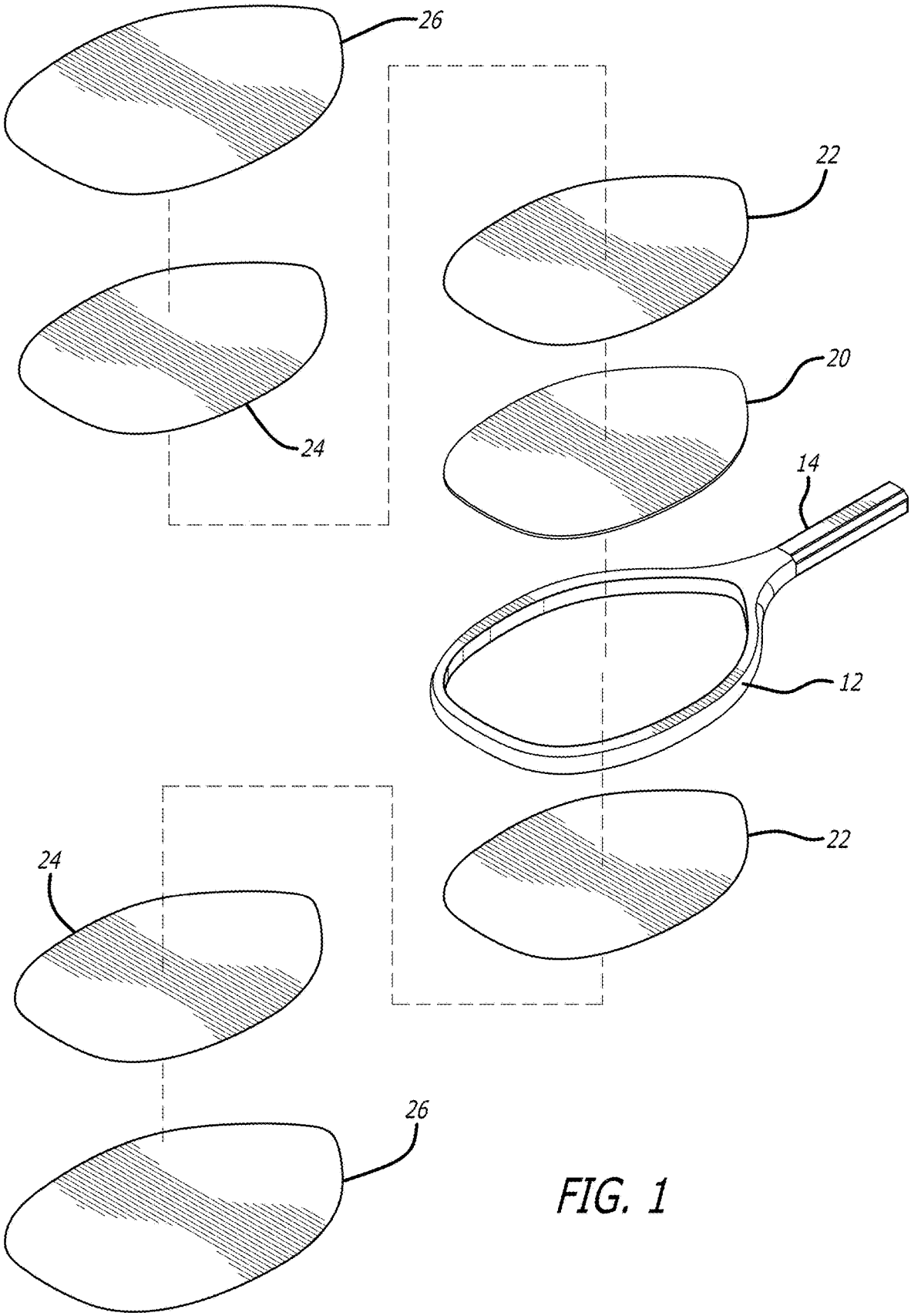
FIG. 1 is an exploded view of a first preferred embodiment of the present invention.
Figure 4:
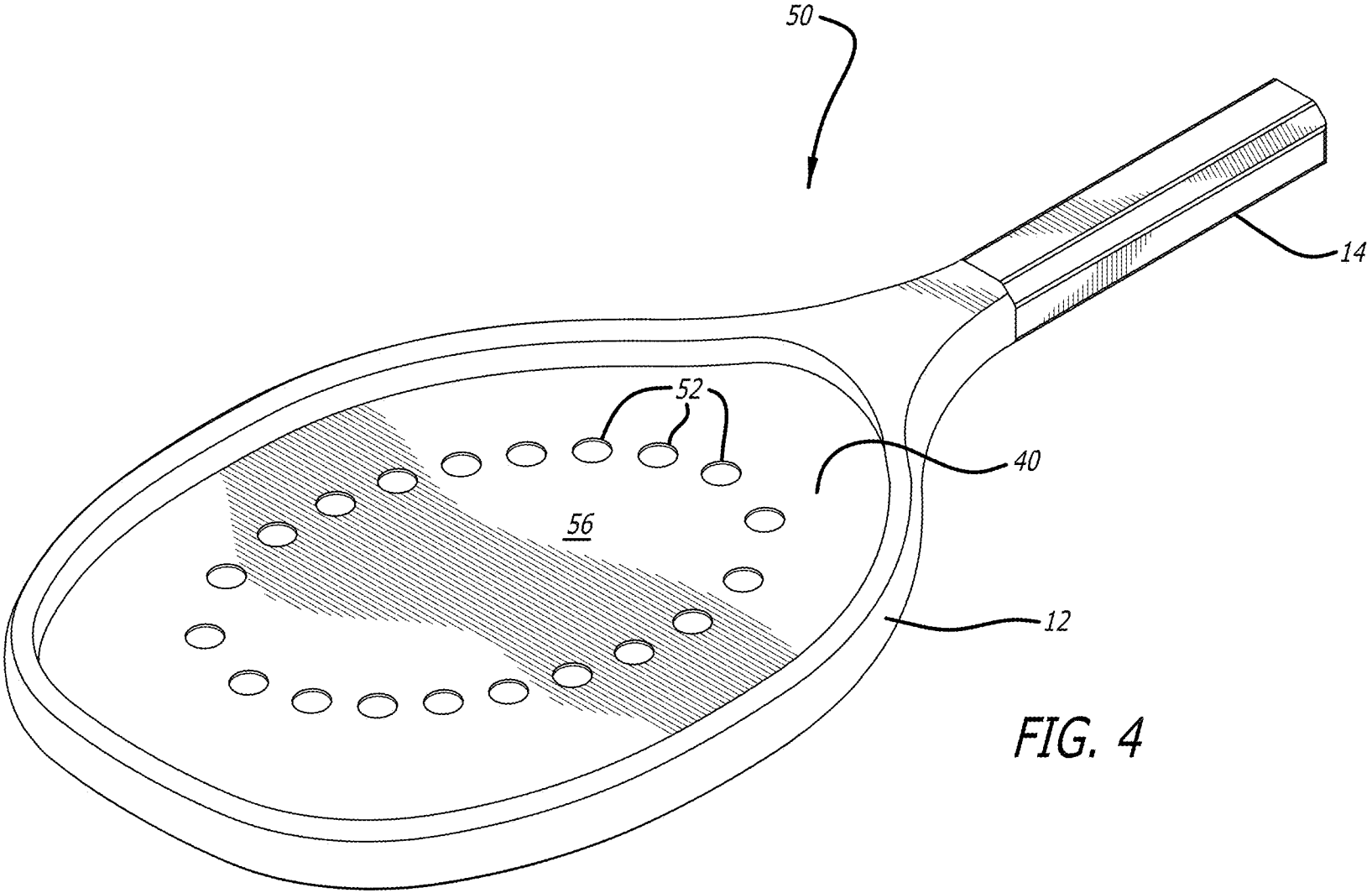
FIG. 4 is an elevated, perspective view of a second embodiment of the present invention.

FIG. 1 illustrates an exploded view of a first high performance beach tennis racquet of the present invention. The racquet comprises a lightweight frame 12 that is attached to a handle 14, which may be wrapped with leather, synthetic leather, foam, cloth, or other grippable material. The striking element of the racquet is comprised of seven distinct layers that are formed into a composite to simulate strings on a tennis racquet. The innermost layer of the striking element is the core, the thickest of the layers at approximately one millimeter. The core may be a resilient material of non-woven polymer, although other cores can be used of natural or synthetic materials such as cork, wood, foam, etc. Onto the core at both exposed surfaces is an ultra-thin layer of carbon fiber 22 of the same size as the core 20. These layers of carbon fiber 22 have another layer of carbon fiber 24 covering the exposed surfaces of the previous layers, again of equal size to the previous layers 20, 22. A third layer of carbon fiber sheets 26 is then applied to the top and bottom of the previous layers, where the third layer has a larger surface area than the previous layers to extend to the frame's 12 perimeter in the undeformed condition. The multi-layer composite striking element 40 is then heated to fuse the layers together and to enclose the inner layers with the frame 12. The result is a striking element 40 that is preferably less than two millimeters and more preferably on the order of one millimeter in thickness after heating. The racquet 10 (FIG. 2) thus has a striking element that comprises a multi-layer composite with a core and fused layers of carbon fiber that is inset within the frame of the racquet like strings on a tennis racquet, and completely fills the area of the frame 12. FIG. 4 illustrates an alternate embodiment of a racquet 50 where post-heating through holes 52 have been punched into the striking element 40 around the "sweet spot" 56 to make the racquet even more aerodynamic.

Figure 2:
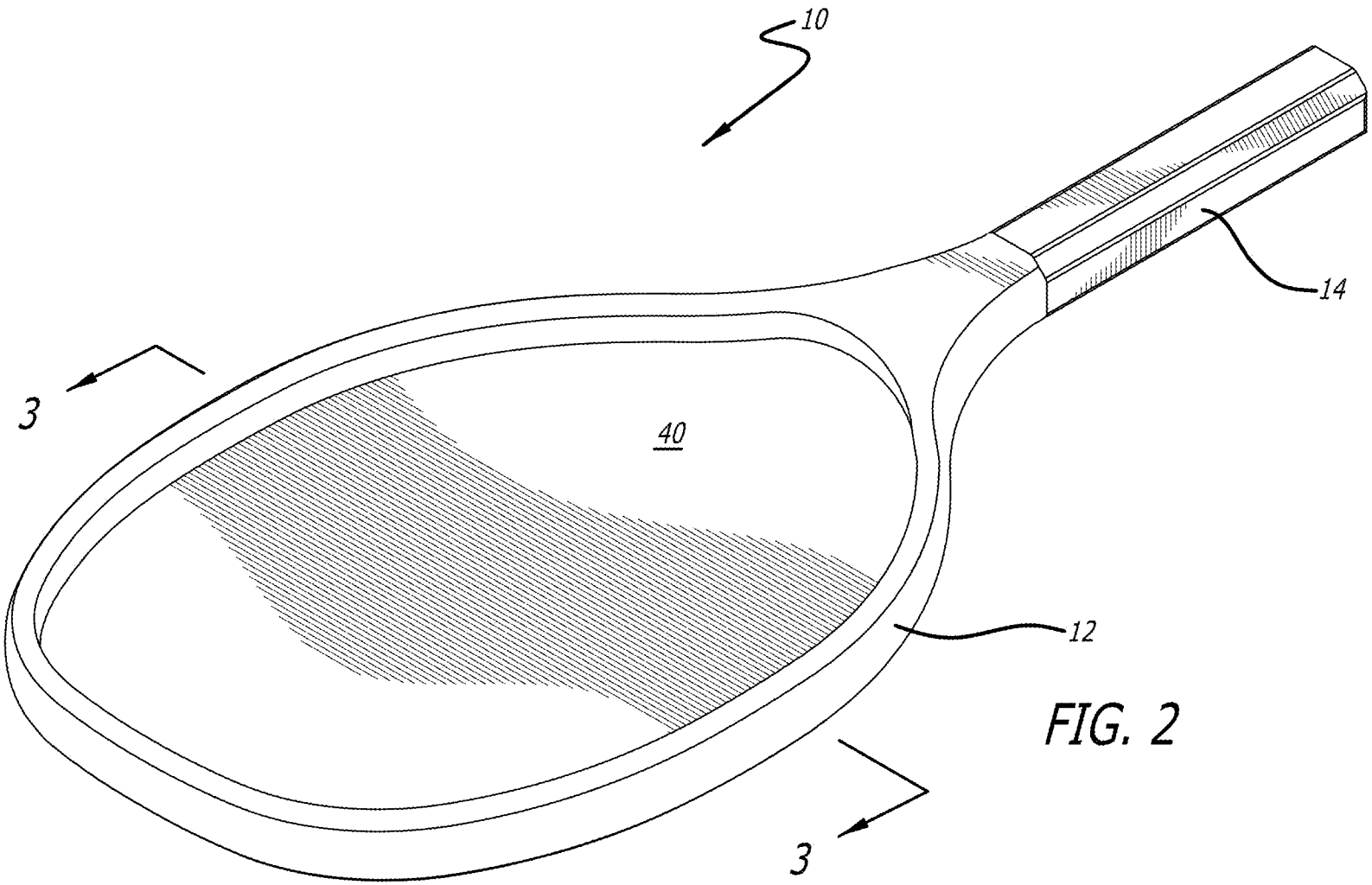
FIG. 2 is an elevated, perspective view of the embodiment of FIG. 1.
Figure 3A:
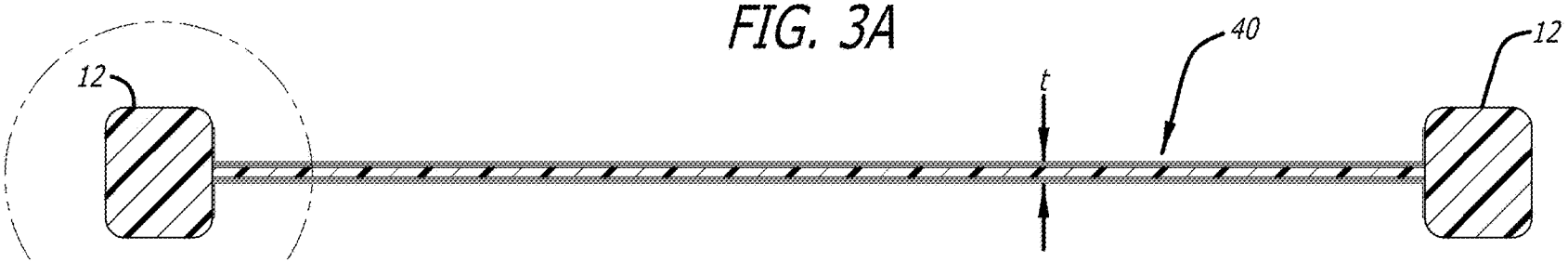
FIG. 3A is a cross sectional view of the embodiment of FIG. 2 taken along line 3-3.
Figure 3B:
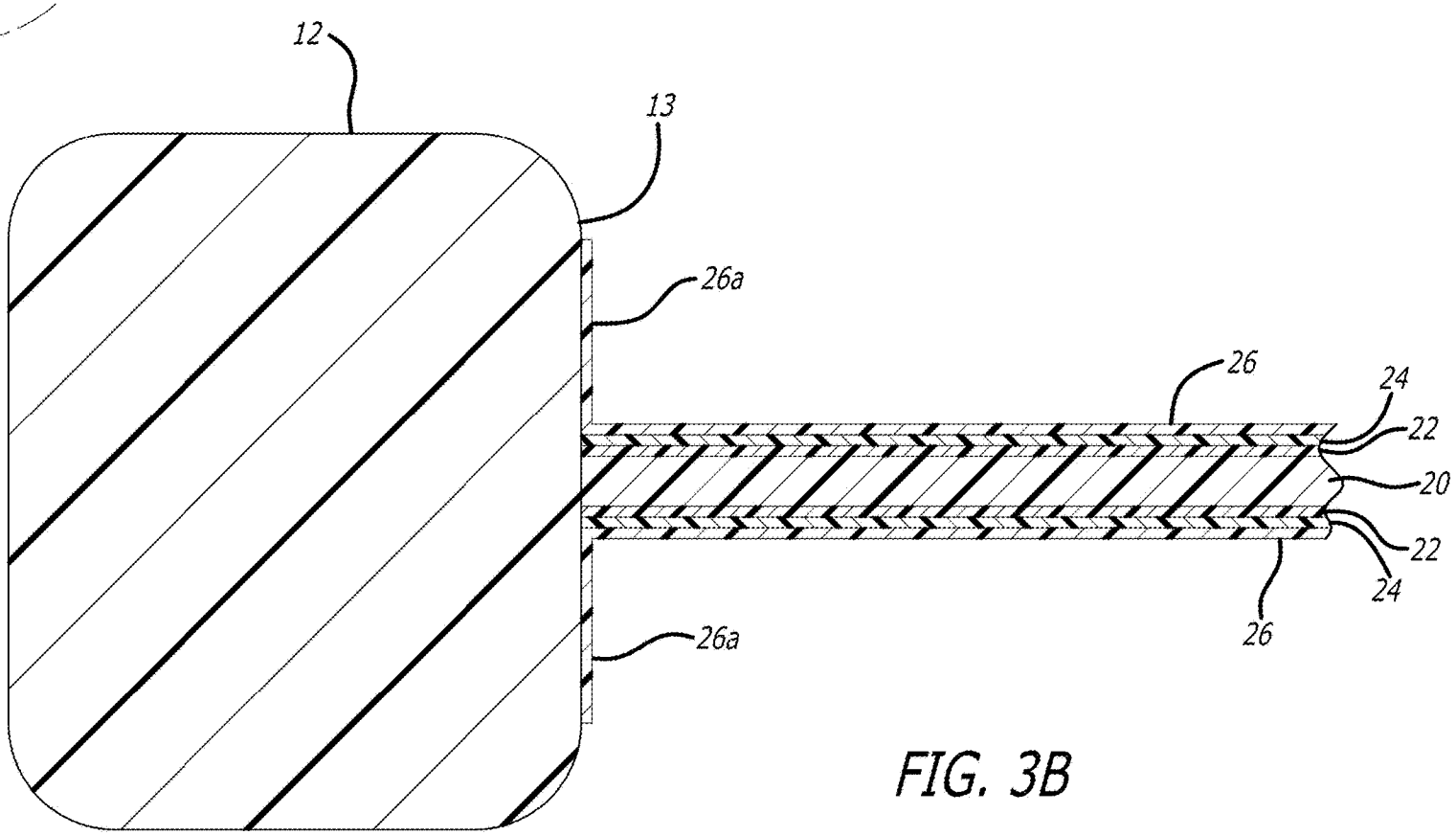
FIG. 3B is an enlarged, cross sectional view of the juncture of the striking element and the frame.

FIG. 3A shows a cross sectional view of the racquet 10 taken along lines 3-3 of FIG. 2. The thickness "t" of the striking element 40 has a maximum value of two millimeters and is preferably less than one and one half millimeters. Conventional paddles could not be used with thicknesses in this range with any material that would also yield a resilient playing surface, and the present inventors are aware of no other paddle having a construction of this type. The striking element 40 is attached to the inner wall 13 of the frame 12 using the outermost carbon fiber layer 26 as best seen in FIG. 3B. The outer fiber layer 26 is larger than the inner layers and when heated and pressure is applied forms an attachment to the inner wall 13 of the frame. A portion 26*a* of the outermost carbon layer 26 adheres to and covers a portion of the inner wall 13 and forms a seal for the other layers as shown.

The foregoing construction provides a high performance beach tennis racquet 10 that most closely simulates a stringed racquet such as those used in tennis. To compare, the evolution of research on tennis equipment has recently introduced some parameters for the evaluation of the racket's efficiency. Among them, the most used in current practice is the coefficient of restitution of the racket (COR), that is simply defined as the ratio of the rebound speed to the incident speed of the ball for orthogonal impact. The COR can be affected by the conditions of balls and the tension of strings, but high end racquets fall within well-established ranges.

The coefficient of restitution (COR) can be derived considering the energy loss during impact. The main sources of energy loss are $E_1$ and $E_2$ due to the instantaneous large deformation of a ball and racquet which is calculated by using the coefficient $e_{BG}$. If a ball collides with a racket at rest (VRo=0), the energy loss $E_2$ could be easily obtained. The coefficient of restitution $e_r$ corresponds to the total energy loss E ($=E_1+E_2$) obtained as $$e_r=(Y_R-V_B)/V_{BO}=[1-2E(m_B+M_r)/(m_BM_rV_{BO})]^{1/2}$$

High end tennis racquets can achieve a coefficient of restitution of between 0.75 to 0.83 for a conventional weight and weight balanced racket [International Scholastic Journal of Science 9 (1) January December, 2015]. Conversely, COR for rubber surface paddles have a COR in the range of 0.5-0.65 [Procedia Engineering 147 (2016) 348-353]. In the racquet of the present invention, the COR was found to be in the range of 0.7-0.8, significantly above the best paddles. The ultra-thin hitting surface of the racquet of the present invention provides a tennis string type response using a flat, solid hitting surface to greatly improve the performance of the racquet.

While several preferred embodiments of the invention have been disclosed and depicted, it is to be understood that the invention is not limited to the embodiments shown in the drawings or described herein unless expressly limited. For example, the layers of the striking element about the core can be fiberglass instead of carbon fiber, or another suitable thin sheet material that provides a suitable response and exhibits proper wear characteristics. Accordingly, the scope of the invention is properly determined by the appended claims, using the ordinary meanings of the words consistent with, but not limited by, this specification.

I claim:

1. A beach tennis racquet comprising:

a handle;

a frame attached to the handle having an inner wall, the frame defining a hitting area; and a composite striking element located within the frame in the hitting area, the composite striking element comprising a non-woven core, first and second sheets of a material selected from fiberglass and carbon fiber applied to and covering first and second sides of the core, respectively, and third and fourth sheets of a material selected from fiberglass and carbon, fiber applied to and covering the first and second sheets, respectively;

wherein the third and fourth sheets have a surface area that is greater than a surface area of the first and second sheets such that a portion of the third and fourth sheets adheres to and covers a portion of the inner wall and forms a seal for the first and second sheets;

wherein a maximum thickness of the composite striking element is no greater than two millimeters.

2. The beach tennis racquet of claim 1, wherein the composite striking surface has a coefficient of restitution of greater than 0.7.

3. The beach tennis racquet of claim 1, wherein the third and fourth sheets have a surface area that is greater than a surface area of the first and second sheets.

4. The beach tennis racquet of claim 1, further comprising fifth and sixth sheets of a material selected from fiberglass and carbon fiber, the fifth and sixth sheets applied to and covering the third and fourth sheets.

5. The beach tennis racquet of claim 4, wherein the fifth and sixth sheets have a surface area that is greater than the surface area of the third and fourth sheets.

6. The beach tennis racquet of claim 5, wherein the maximum thickness of the composite striking element is less than 1.5 millimeters.

7. The beach tennis racquet of claim 5, wherein the maximum thickness of the composite striking surface is approximately one millimeter.

8. The beach tennis racquet of claim 1, wherein the composite striking element is centered at an inner wall of the frame.

9. The beach tennis racquet of claim 1, wherein the composite striking element includes holes located around a central area.

* * * * *